US010561257B2

(12) United States Patent
Young-Loaeza

(10) Patent No.: US 10,561,257 B2
(45) Date of Patent: Feb. 18, 2020

(54) BED SHEETS AND RELATED METHODS

(71) Applicant: Ruth Young-Loaeza, San Diego, CA (US)

(72) Inventor: Ruth Young-Loaeza, San Diego, CA (US)

(73) Assignee: Ruth Young-Loaeza, San Diego, CA (US)

( * ) Notice: Subject to any disclaimer, the term of this patent is extended or adjusted under 35 U.S.C. 154(b) by 0 days.

(21) Appl. No.: 15/846,116

(22) Filed: Dec. 18, 2017

(65) Prior Publication Data

US 2019/0069696 A1 Mar. 7, 2019

Related U.S. Application Data

(60) Provisional application No. 62/555,284, filed on Sep. 7, 2017.

(51) Int. Cl.
*A47G 9/02* (2006.01)

(52) U.S. Cl.
CPC ..... *A47G 9/0246* (2013.01)

(58) Field of Classification Search
CPC .. A47G 9/0246; A47G 9/0248; A47G 9/0238; A47G 9/02
See application file for complete search history.

(56) References Cited

U.S. PATENT DOCUMENTS 1,359,526 A 11/1920 Ray
2,942,280 A 6/1960 Winston, Jr.
3,111,688 A 11/1963 Barnes
3,114,156 A 12/1963 Cobb
3,142,072 A 7/1964 Goodson, Jr.
4,461,049 A 7/1984 Hammond
4,704,753 A 11/1987 Lunt
4,727,608 A 3/1988 Joyce
(Continued)

FOREIGN PATENT DOCUMENTS

DE 2829873 A2 1/1980
EP 0425466 A1 10/1990
(Continued)

OTHER PUBLICATIONS

AU Lit Fine Linens. Size Chart. Aug. 26, 2017. https://www.aulitfinelinens.com/blogs/tips-advice/size-chart (Year: 2017).*

*Primary Examiner* — Eric J Kurilla
(74) *Attorney, Agent, or Firm* — Lee & Hayes, P.C.

(57) ABSTRACT

An adjustable bed sheet includes a sheet made of a first material. The sheet spans at least the length and the width of the mattress. A perimeter of the sheet is defined by edges thereof. The bed sheet also includes an elongated strip made of a second material that is more stretchable than the first material. The strip has a first elongated side opposite a second elongated side. The strip is attached, via the first elongated side, to an edge of the sheet such that, when the adjustable bed sheet is applied to the mattress, the strip is positioned, with respect to the mattress, to extend around at least one corner of the mattress from the length side of the mattress to the width side of the mattress. An end flap is attached to and hanging from the second elongated side of the strip.

16 Claims, 5 Drawing Sheets

(56) References Cited

U.S. PATENT DOCUMENTS

| | | | | |
|---|---|---|---|---|
| 4,734,947 | A * | 4/1988 | Vitale | A47G 9/0253 5/493 |
| 4,912,790 | A | 4/1990 | MacDonald | |
| 4,980,941 | A | 1/1991 | Johnson, III | |
| 5,230,111 | A | 7/1993 | Davis | |
| 5,247,893 | A * | 9/1993 | Zafiroglu | A47G 9/0246 112/475.08 |
| 5,249,322 | A | 10/1993 | Seago | |
| 5,287,674 | A | 2/1994 | Kardell | |
| 5,636,393 | A * | 6/1997 | Zafiroglu | A47G 9/0246 428/102 |
| 5,749,110 | A * | 5/1998 | Gamble | A47G 9/0292 5/493 |
| 6,499,157 | B1 | 12/2002 | McCain et al. | |
| 7,398,570 | B2 | 7/2008 | Seago | |
| 8,640,282 | B2 | 2/2014 | Maguire | |
| 8,904,581 | B2 | 12/2014 | Rabbany | |
| D742,660 | S | 11/2015 | Oberwelz et al. | |
| D746,084 | S | 12/2015 | Jensen et al. | |
| 9,314,059 | B2 * | 4/2016 | Kanayama | A41D 31/02 |
| 2003/0019037 | A1 * | 1/2003 | Michaelis | A47G 9/02 5/497 |
| 2005/0011007 | A1 | 1/2005 | Lintner | |
| 2007/0056100 | A1 | 3/2007 | Stewart | |
| 2007/0266495 | A1 * | 11/2007 | Stribling | A47G 9/0246 5/497 |
| 2008/0263768 | A1 | 10/2008 | Balasundharam | |
| 2011/0314604 | A1 | 12/2011 | Hoo | |
| 2013/0042411 | A1 | 2/2013 | Vitale | |
| 2014/0150181 | A1 | 6/2014 | Tulloch | |
| 2014/0366270 | A1 | 12/2014 | Garlock | |
| 2015/0020311 | A1 | 1/2015 | Bensoussan | |
| 2015/0327696 | A1 * | 11/2015 | Patterson | A47G 9/0246 5/497 |

FOREIGN PATENT DOCUMENTS

| | | | |
|---|---|---|---|
| EP | 0787451 | A2 | 6/1997 |
| EP | 1946679 | A1 | 7/2008 |
| EP | 2087815 | A1 | 12/2009 |

* cited by examiner

BED SHEETS AND RELATED METHODS

CROSS-REFERENCE TO RELATED APPLICATIONS

This application claims the benefit and priority of U.S. Provisional Application No. 62/555,284 (filed Sep. 7, 2017).

BACKGROUND

The disclosed subject matter is in the field of mattress covers and bedding. More specifically, the disclosed subject matter features bed sheets with adjustable components and elements to improve the efficiency of dressing a mattress and securing the integrity of the bed sheet when on a mattress.

Mattress coverings and sheets are essential components for providing a comfortable sleeping environment and they also provide protection for both the mattress and user. Mattress decor is also a central and key aspect of a bedroom. Significant funds and societal value are invested in the aesthetic task of arranging a sheet on the bed.

Mattresses come in a variety of sizes, and, therefore, many types of mattress coverings covering a variety of dimensions have been designed to accommodate the various mattress sizes. The introduction of supplemental mattress pads have only added to the field of possible mattress dimensions. As a result, mattress coverings have to be purchased to fit each respective mattress size separately.

Furthermore, conventional bed sheets may rip apart or tear in the middle of the sheet due to stretching and fatigue. Additionally, the stitching or fabric around the edges and corners may also rip or tear due to wear and tear after repeated pulling and tugging from putting sheets on a bed.

Also, in some households, people have plastic mattress protectors over their mattresses, which results in a traditional bed sheet slipping off of the mattress.

Covering a mattress can be a time consuming and labor intensive project, especially for professions that require repetitive stripping and recovering of mattresses. Additionally, many people do not enjoy making a bed because of the frustrations that come with trying to put a bed sheet on a bed. Furthermore, studies have shown that prolonged leaning during bed-making leads to musculoskeletal disorders. (See Silva JS Jr., et. al., Evaluation of Lumbar Overload in Hotel Maids, US National Institutes of Health (2012).

In addition to the time and effort it takes to make a bed, current bed sheets can often come undone/untucked from the mattress when a user moves on top of the bed sheet, thereby causing the sheet to be tugged and pulled out from under the mattress.

Therefore, a need exists for an efficient and adjustable mattress covering system. A need also exists to stop the sheet from being pulled out from under the mattress by reason of user movement on top of the sheet when on the mattress. Accordingly, a solution may be sought for an easier and more efficient process of dressing a mattress with a bed sheet. Further, it is also desired for the bed sheet to better stay on the mattress when a user moves around on top of the sheet.

SUMMARY

The instant disclosure discusses coverings for a mattress that improve the efficiency of putting the coverings on the mattress. Hereinafter, the term "mattress covering" may interchangeably refer to a "bed sheet" and vice versa. Moreover, the term "bed sheet" may naturally include fitted or flat sheets.

The instant disclosure discusses a mattress covering that may include elastic members sewn into the top edge and corners of the mattress covering. The elastic members permit flexibility and stretching of the mattress covering. The elastic members may also prevent the mattress covering from ripping or tearing in the middle or along the edges and corners, which may occur from repeated tugging and pulling of the mattress covering. An advantage of the subject matter of the instant disclosure may be to maintain the integrity of the fitted mattress covering once spread over a mattress and to allow for more efficient mattress dressing. Another advantage of the subject matter of the instant disclosure may be to prevent the fabric or stitching on bed sheets from ripping or tearing in the middle or around the edges and corners of the bed sheet.

The instant disclosure also contemplates a flat sheet that may be used as a blanket.

The instant disclosure also contemplates a flat sheet that looks like a bed cover when a portion of the flat sheet is untucked from the mattress.

The instant disclosure also contemplates a bed sheet that may not slip off when there is a plastic mattress protector under the bed sheet.

The instant disclosure also contemplates a bed sheet that may include parallel drawstrings extending along the length of the bed sheet. Pulling the drawstrings may cause a progressive gathering of the bed sheet's distal end, resulting in a shortened and gathered coverage of the bed sheet over a portion of the mattress. Thus, the user may adjust the length of the bed sheet via the drawstrings. Further, the drawstrings may be tied together to secure the adjusted bed sheet at a desired length. The bed sheet may also include stitched corners on the distal end of the bed sheet to permit the securement of the distal end of the bed sheet to the mattress through enveloping and gripping the end surface of the mattress. Once secured to the end of the mattress, the remaining portion of the bed sheet may be pulled longitudinally to cover the top surface of the mattress.

The instant disclosure also contemplates additional fabric covering the stitched distal corners of the bed sheet. In one embodiment, the bed sheet covers the top surface of the mattress, while the additional fabric (sewn into the distal end of the bed sheet) lays over the distal end of the mattress covering the side of the mattress, as well as the stitched corners, thereby providing a more complete and aesthetically pleasing mattress covering presentation. The length of the additional fabric permits the fabric to be tucked underneath the mattress.

The instant disclosure also contemplates a slit in the bed sheet, configured to allow air to escape from the space between the mattress and the sheet when applied to the bed.

The instant disclosure also contemplates an apparatus that attempts to minimize user time expenditure and effort in dressing a mattress.

BRIEF DESCRIPTION OF THE DRAWINGS

Other objectives of the disclosure will become apparent to those skilled in the art throughout the description. The manner in which these objectives and other desirable characteristics can be obtained is explained in the following description and attached figures in which.

DETAILED DESCRIPTION OF THE DRAWINGS

Figure 1:
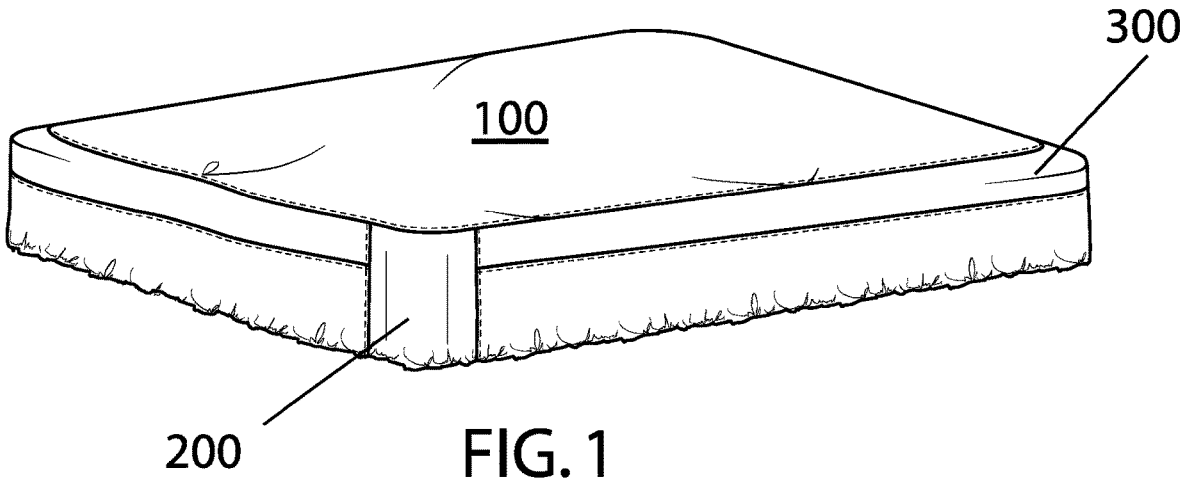
FIG. 1 is a perspective view of a bed sheet covering a mattress according to an embodiment of the instant disclosure.

Generally disclosed is a bed sheet that allows for adjustable, easy, and efficient application of a bed sheet to a mattress and with a mechanism that allows for movement of the sheet without it coming undone from the mattress. FIG. 1 is a perspective view of one embodiment of the bed sheet 100. Referring to FIG. 1, in one embodiment, the bed sheet 100 may be a fitted sheet with stretchable material sewn into the edges 300 and corners 200 of the bed sheet 100. Like a generic fitted sheet, the bed sheet 100 may also feature elastic along the perimeter of the bottom of the bed sheet 100 to fit under the bottom of a mattress. The stretchable edge 300 and corner 200 may be composed of a stretchable material, such as Lycra®, spandex, elastane, elastic, or other stretch fabric. The stretchable edge 300 and corner 200 allow a user to move around on the bed and pull and tug the material on the top of the mattress without pulling portions of the bed sheet 100 out from under the mattress. That is, the stretchable edges 300 and corners 200 allow the portion of the bed sheet 100 on top of the mattress to move without interfering with the integrity of the sides and corner of the bed sheet that keep it secure on the mattress.

Figure 2:
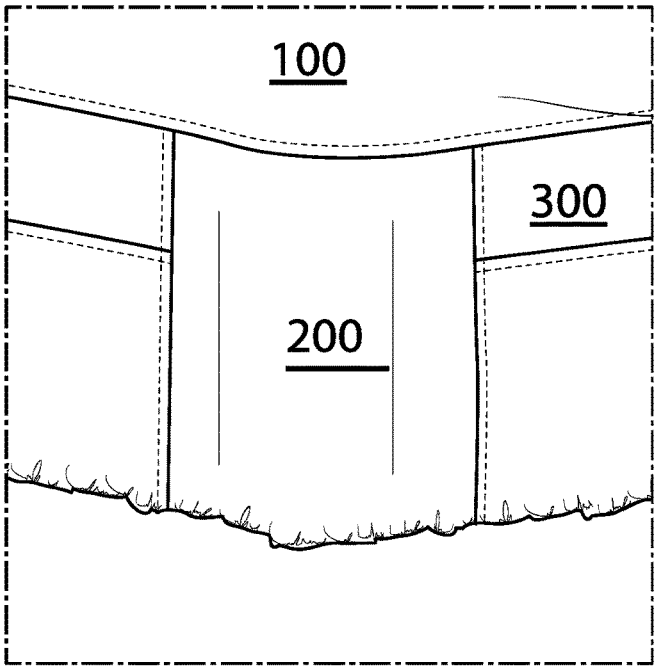
FIG. 2 is a partial detailed view of the corner of the bed sheet of FIG. 1 when covering a mattress.

FIG. 2 is a partial detailed view of the corner 200 of the bed sheet 100. Referring to FIG. 2, the "T" or "Y" shaped formation of the stretchable corners 200 and edges 300 are configured to allow for easy application of the bed sheet 100 on a mattress because when a user puts a sheet on mattress, he or she generally starts by slipping the sheet under one corner of the mattress as an anchor point and applying the remainder of the sheet by pulling and tugging the sheet from the secured corner and tucking in the remainder of the bed sheet 100 under the remaining corners and edges of the mattress.

Figure 3:
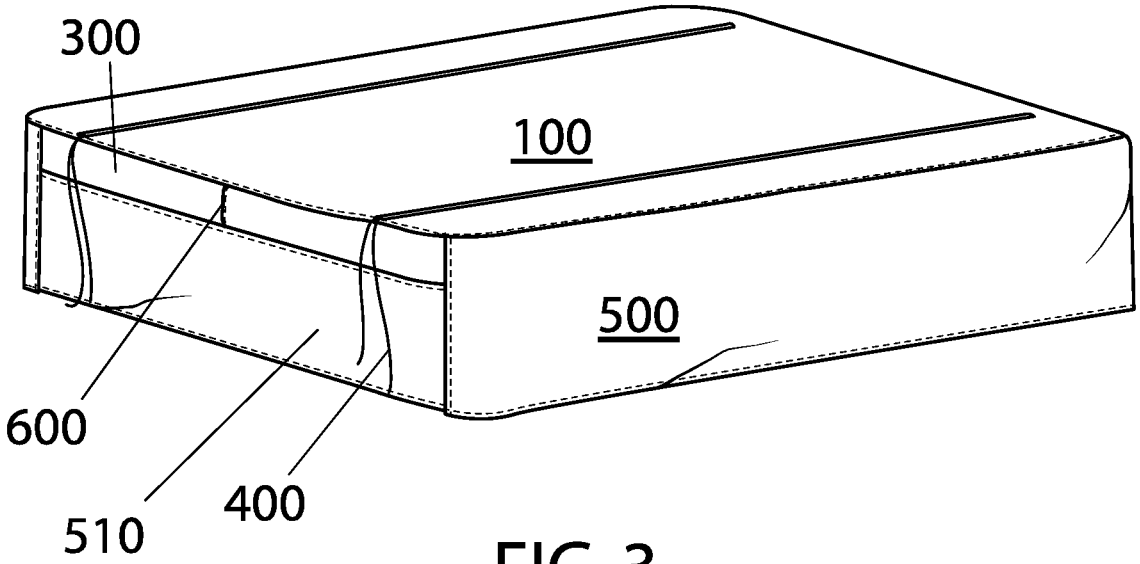
FIG. 3 is a perspective view of a bed sheet covering a mattress with a side flap laid down over the side of the mattress according to an embodiment of the instant disclosure.
Figure 4:
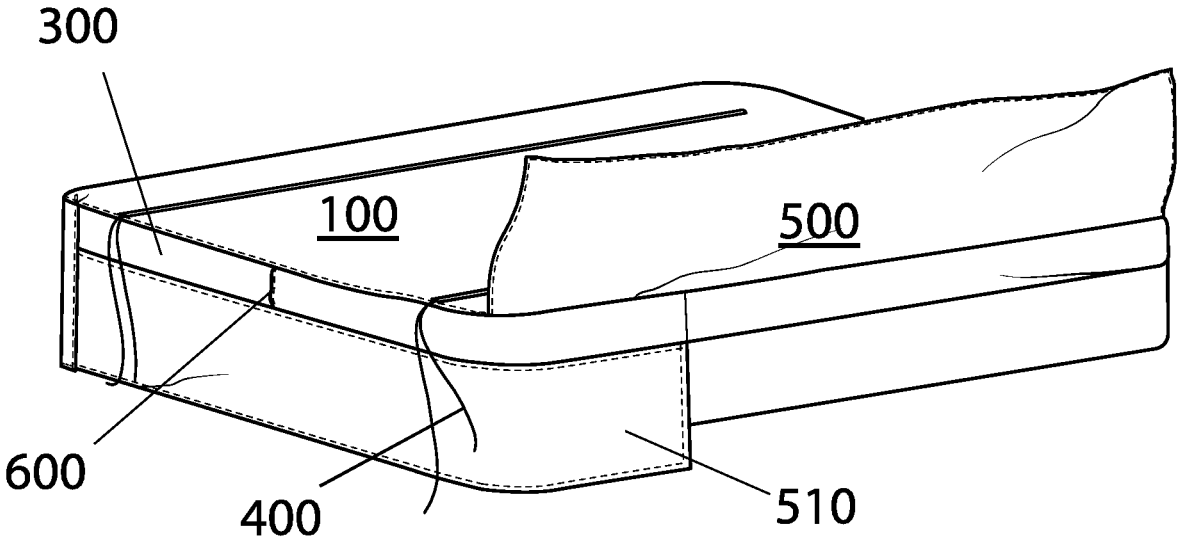
FIG. 4 is a perspective view of the bed sheet of FIG. 3 covering a mattress with the side flap lifted up revealing the underlying mattress.

FIGS. 3 and 4 are perspective views of one embodiment of the bed sheet 100. Referring to FIGS. 3 and 4, the bed sheet 100 is shown as a flat sheet that features side flaps 500 which hang down from the edge of the mattress along the length of the bed sheet 100. In an alternative embodiment, the side flaps 500 may hang down from three sides of the bed sheet 100. Referring to FIG. 4, the bed sheet 100 may be a flat sheet and feature an end flap 510 sewn into the end of the bed sheet 100 so that it wraps around and extends past a portion of the bottom two corners of the mattress. This allows for the end flap 510 to "catch" onto the end of the mattress and allow the user to easily pull the bed sheet 100 across the remainder of the mattress. That is, this end flap 510 allows for an easier and more efficient application of a flat sheet to a mattress because the end flaps 510 may be placed over the bottom of the mattress and then the bed sheet 100 is pulled in the opposite direction until the end flaps 510 catch against the corners and bottom of the mattress, wherein the bed sheet 100 becomes taut. Once the bed sheet 100 is taut, the side flaps 500 may be tucked in and under the remaining sides of the mattress. In an alternative embodiment, the bed sheet 100 has both ends defined by the end flap 510 and it may be used as a bottom flat sheet that is placed beneath another bed sheet 100 with only one end flap 510.

Figure 8:
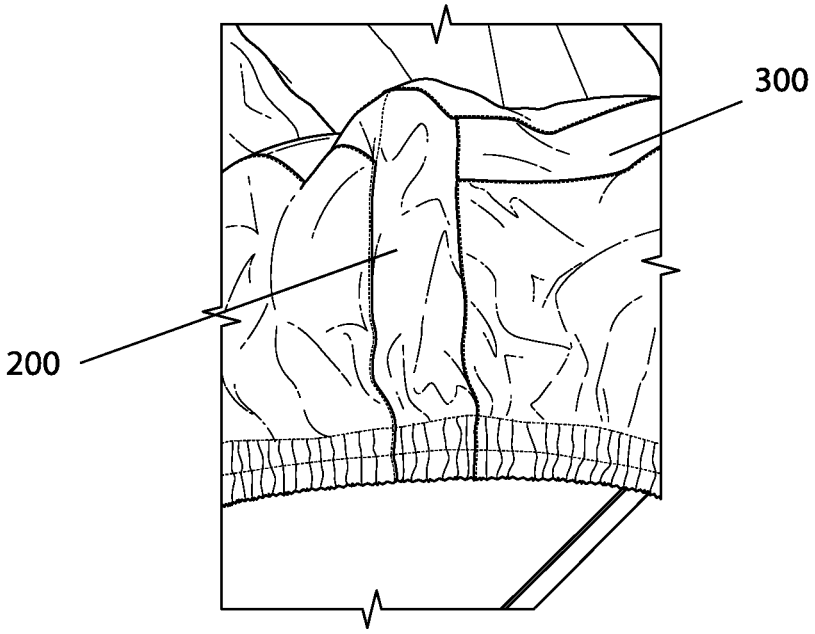
FIG. 8 is a partial detailed view of an elastic corner and stretchable edging of a bed sheet according to an embodiment of the instant disclosure.

FIGS. 1, 2 and 8 show the stretchable corner 200. In one embodiment, the stretchable corner 200 anchors the bed sheet 100 through catching and attaching to the edges of a mattress in a hooking fashion. Once anchored around the mattress edge, the bed sheet 100 may be pulled flat along the top length of the mattress covering it entirely.

Still referring to FIGS. 3 and 4, the bed sheet 100 may feature a drawstring 400, wherein the drawstring 400 extends along the length of the bed sheet 100. In another embodiment, the drawstring 400 may extend only along a portion of the length of the bed sheet 100, for example, the drawstring 400 may extend along half the length of the bed sheet 100 or along a third of the length of the bed sheet 100. In an embodiment, the drawstring 400 is positioned on the bed sheet 100 wherein it is several inches inside of the edge of the mattress. That is, there is a portion of space between the drawstring 400 and the edge of the bed sheet 100 when it is on the mattress.

Still referring to FIG. 4, in an embodiment, the stretchable edge 300 only extends along the length of end flap 510.

Figure 5:
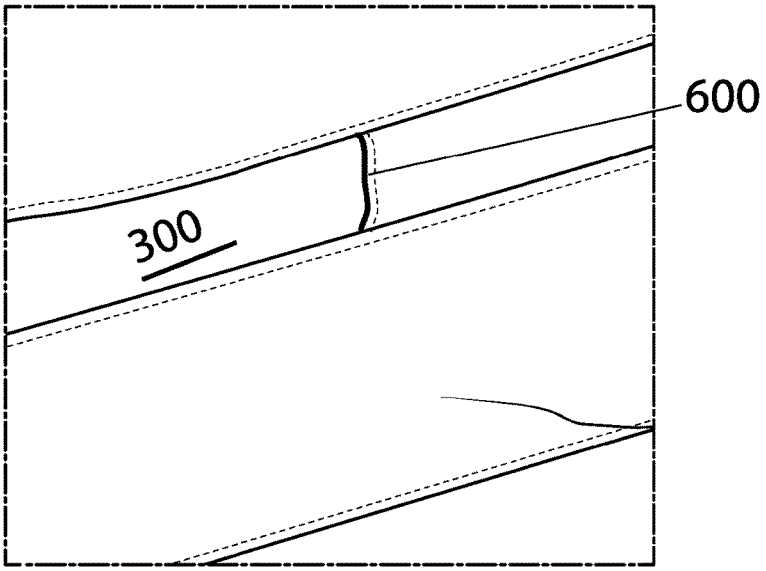
FIG. 5 is a partial detailed view of stretchable edging and a slit of a bed sheet according to an embodiment of the instant disclosure.

FIG. 5 is a partial detailed view of the end of one embodiment of the bed sheet 100. Referring to FIG. 5, in one embodiment, the bed sheet 100 may feature a slit 600. The slit 600 allows air to escape from the under the bed sheet 100 when applied to a mattress. Frequently, there is an air bubble that is created when a bed sheet 100 is put onto a mattress, so the slit 600 allows for air to escape more quickly and allows a user to push air out of the slit 600. In an alternative embodiment, the slit 600 may be used to access a plug for an air mattress, permitting attachment of an air pump without having to strip the coverings off the mattress.

Figure 6:
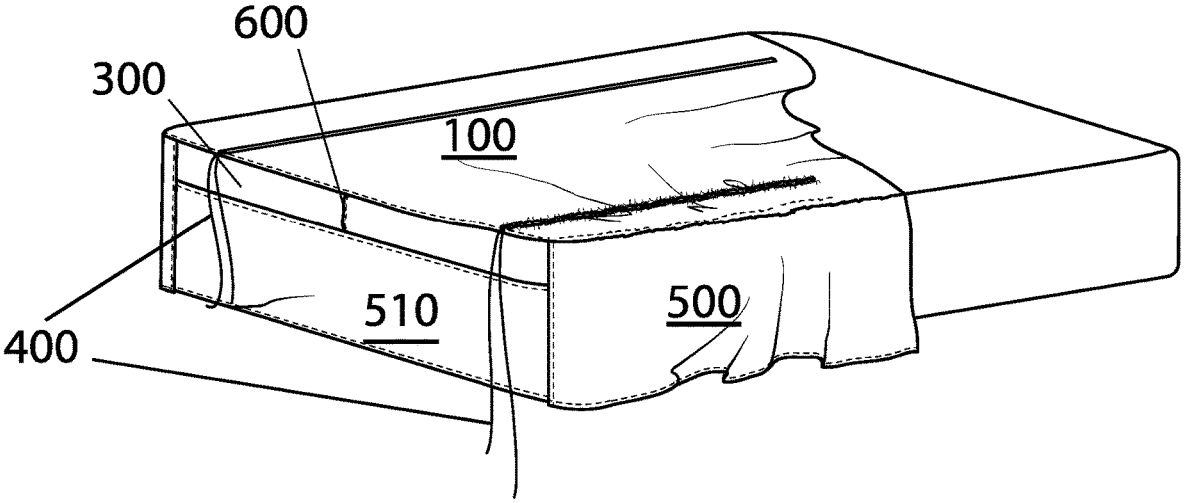
FIG. 6 is a perspective view of a bed sheet covering a mattress with drawstrings for shortening the bed sheet according to an embodiment of the instant disclosure.
Figure 7:
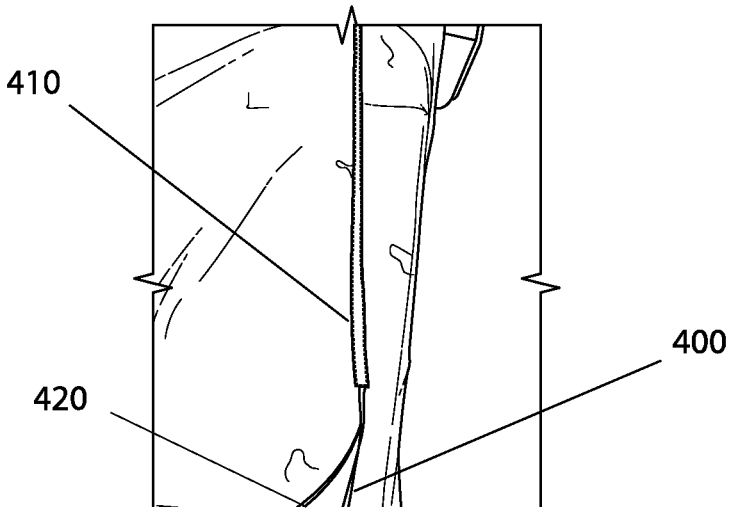
FIG. 7 is a perspective view of the drawstrings of FIG. 6 with the bed sheet in an elongated configuration according to an embodiment of the instant disclosure.

FIG. 6 is a perspective view of the drawstring 400 pulled, wherein the length of the sheet is shortened and the material of the bed sheet 100 is gathered. FIG. 7 is a partial detailed view of the drawstring 400. Referring to FIG. 7, the bed sheet 100 features a drawstring cavity 410, wherein the drawstring 400 is sewn into one end and housed. Referring to FIG. 7, there is also shown a tie-off string 420 sewn into the drawstring cavity 410, which allows a user to tie a knot with the drawstring 400 and the tie-off string 420 to secure the drawstring 400 in place and secure the adjusted length of the bed sheet 100 in place. Referring to FIGS. 3, 4, 6, and 7, in use, if a user wants to shorten the length of the bed sheet 100, the user may grab the tie-off string 420 or a portion of the bed sheet 100 and pull the drawstring 400, which will cause the bed sheet 100 to gather and shorten (see FIG. 6). In one embodiment, the bed sheet 100 may feature just the drawstring cavity 410, drawstring 400, and tie-off string 420. In an alternative embodiment, the bed sheet 100 may only feature the stretchable edge 300, at least one end flap 510, and at least one side flap 500.

FIG. 8 is a partial detailed view of one embodiment of the bed sheet 100 with the stretchable corners 200 and edges 300.

Figure 9:
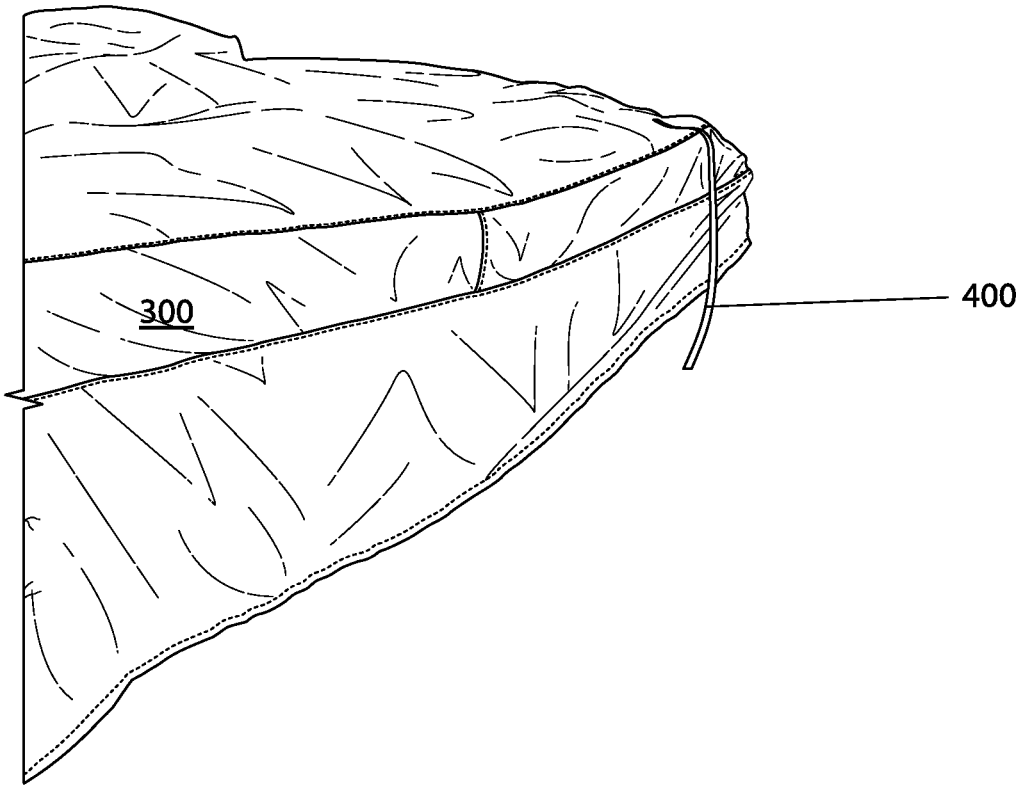
FIG. 9 is a perspective view of a bed sheet covering a mattress with drawstrings relaxed and the bed sheet in an elongated configuration according to an embodiment of the instant disclosure.

FIG. 9 is a perspective view of the end of one embodiment of the bed sheet 100.

In an embodiment, the bed sheet 100 completely encompasses the mattress with the stretchable corners 200 and stretchable edging 300 extending between the panels of the bed sheet 100.

FIGS. 3, 4 and 6 show the bed sheet 100 side flaps 500. In one embodiment, the side flaps 500 may be laid across a mattress edge covering the edge. In another embodiment, the side flaps 500 may be tucked underneath the mattress for a different aesthetic appearance.

In one embodiment, the bed sheet 100 may be 90 inches in width and 87 inches in length. In an alternative embodiment, the bed sheet may be 108 inches in width and 102 inches in length, wherein the end flap may be 14 inches in length. In an alternative embodiment, the bed sheet 100 may be 81 inches in width and 96 inches in length. In another embodiment, the bed sheet 100 may be 66 inches in width and 96 inches in length. In an embodiment, the stretchable edge may be 4 inches in height and is sewn into the edges of the bed sheet 100. In an embodiment, the stretchable corner is 4 inches in width and sewn into the corners of the bed sheet 100.

In an embodiment, the bed sheet 100 may be a fitted sheet, wherein the bottom elastic that wraps under the mattress and secures the bed sheet 100 on a mattress is in a range from one to three and a half inches (1"-3½"). This allows for a more taut fit around the mattress, wherein the bed sheet 100 exhibits less gathering and ruffling around the sides of the mattress. That is, the wider elastic provides a more secure and taut fit.

The bed sheet 100 may facilitate a more efficient process of making a bed and putting a bed sheet on a mattress because of the unique configuration of end flaps 510, side flaps 500, and stretchable edge 300. As a result, the bed sheet 100 may cut the amount of time to make a bed in half. That is, it may take 8-10 minutes to make a bed with traditional sheets, but with a bed sheet 100 as disclosed herein, it may reduce the time to make a bed to 3-4 minutes. In the hospitality industry, this allows hotels to make beds more quickly and more efficiently, thereby, saving time and money.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

All original claims submitted with this specification are incorporated by reference in their entirety as if fully set forth herein.

I claim:

1. An adjustable bed sheet sized to cover a mattress having a length defined by a length dimension and, a width defined by a width dimension, and a height defined by a thickness of the mattress, the bed sheet comprising:

a sheet made of a first material, the sheet spanning at least the length and the width of the mattress, a perimeter of the sheet being defined by edges thereof;

an elongated strip made of a second material that is more stretchable than the first material, the strip having a length that extends in a direction of elongation thereof and a width that extends from a first elongated side to a second elongated side, the width of the strip being less than the height of the mattress, and the strip being attached, via the first elongated side, to an edge of the sheet such that, when the adjustable bed sheet is applied to the mattress, the strip is positioned, with respect to the mattress, to extend around at least one corner of the mattress from the length dimension of the mattress to the width dimension of the mattress; and an end flap attached to and hanging from the second elongated side of the strip, wherein the strip includes a first portion, a second portion, and a third portion, wherein the first portion of the strip is attached to the edge of the sheet such that, when the bed sheet is applied to the mattress, the first portion of the strip extends along the width dimension of the mattress, wherein the second portion of the strip extends under the sheet and is attached to an underside of the sheet such that, when the bed sheet is applied to the mattress:

the second portion of the strip extends along the length dimension of the sheet, and a first portion of the sheet is a first flap that hangs over and hides the second portion of the strip along the length dimension of the mattress, and wherein the third portion of the strip extends under the sheet and is attached to the underside of the sheet such that, when the bed sheet is applied to the mattress:

the third portion of the strip extends along the length dimension of the sheet, and a second portion of the sheet is a second flap that hangs over and hides the third portion of the strip along the length dimension of the mattress.

2. The adjustable bed sheet of claim 1, further comprising a drawstring that extends lengthwise along the sheet, the drawstring being disposed on the sheet such that, when the adjustable bed sheet is applied to the mattress, the drawstring extends along an upper surface of the mattress.

3. The adjustable bed sheet of claim 2, further comprising a drawstring cavity that extends lengthwise along the sheet, wherein the drawstring is disposed within the drawstring cavity and attached to the cavity on an end thereof.

4. The adjustable bed sheet of claim 3, further comprising a tie-off string disposed at an opening of the drawstring cavity to hold the drawstring in a desired position.

5. The adjustable bed sheet of claim 1, wherein the strip is sewn to the sheet.

6. The adjustable bed sheet of claim 1, further comprising a slit opening in the elongated strip, positioned to allow air to escape from under the adjustable bed sheet when applied to the mattress.

7. The adjustable bed sheet of claim 1, wherein the second material includes elastane.

8. The adjustable bed sheet of claim 1, wherein a width of the sheet ranges from 66 inches to 108 inches in width, and wherein a length of the sheet ranges from 96 inches to 102 inches.

9. The adjustable bed sheet of claim 1, wherein a width of the strip between the first elongated side and the second elongated side is 4 inches in height.

10. A bed sheet sized to cover a mattress having a length defined by a length dimension and, a width defined by a width dimension, and a height defined by a thickness of the mattress, the bed sheet comprising:

a sheet made of a first material, the sheet spanning at least the length and the width of the mattress, a perimeter of the sheet being defined by edges thereof; and an elongated strip made of a second material that is more stretchable than the first material, the strip having a length that extends in a direction of elongation thereof and a width that extends from a first elongated side to a second elongated side, the width of the strip being less than the height of the mattress, and the strip being attached, via the first elongated side, to an edge of the sheet such that, when the bed sheet is applied to the mattress, the strip is positioned, with respect to the mattress, to extend around at least one corner of the mattress from the length dimension of the mattress to the width dimension of the mattress, wherein the strip includes a first portion, a second portion, and a third portion, wherein the first portion of the strip is attached to the edge of the sheet such that, when the bed sheet is applied to the mattress, the first portion of the strip extends along the width dimension of the mattress, wherein the second portion of the strip extends under the sheet and is attached to an underside of the sheet such that, when the bed sheet is applied to the mattress:

the second portion of the strip extends along the length dimension of the sheet, and a first portion of the sheet is a first flap that hangs over and hides the second portion of the strip along the length dimension of the mattress, and wherein the third portion of the strip extends under the sheet and is attached to the underside of the sheet such that, when the bed sheet is applied to the mattress:

the third portion of the strip extends along the length dimension of the sheet, and a second portion of the sheet is a second flap that hangs over and hides the third portion of the strip along the length dimension of the mattress.

11. The bed sheet according to claim 10, further comprising an end flap attached to the second elongated side of the strip, the end flap sized to extend across the width of the mattress.

12. The bed sheet according to claim 10, further comprising a side flap attached to the sheet, the side flap sized to extend across the length of the mattress.

13. The bed sheet according to claim 10, further comprising a slit opening within the bed sheet to allow air to escape from under the bed sheet when applied to the mattress.

14. The bed sheet according to claim 10, further comprising:

at least one side flap that hangs from the sheet, when the bed sheet is applied to the mattress, along the length dimension of the mattress; and an end flap that hangs, when the bed sheet is applied to the mattress, along the width dimension of the mattress.

15. The bed sheet according to claim 10, wherein a length of the strip is such that the strip extends around at least two corners of the mattress, when the bed sheet is applied to the mattress.

16. The bed sheet according to claim 10, wherein the strip is positioned with respect to the sheet such that when the bed sheet is applied to the mattress, the strip is located adjacent at least a portion of the length dimension and at least a portion of the width dimension of the mattress.

* * * * *